US006441700B2

(12) United States Patent
Xu

(10) Patent No.: US 6,441,700 B2
(45) Date of Patent: Aug. 27, 2002

(54) PHASE SHIFTER ARRANGEMENT HAVING RELATIVELY MOVABLE MEMBER WITH PROJECTIONS

(75) Inventor: Gang Xu, Reservior (AU)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 09/271,866

(22) Filed: Mar. 18, 1999

(30) Foreign Application Priority Data

Mar. 18, 1998 (AU) ..... PP2419
Feb. 1, 1999 (AU) ..... 14278/99

(51) Int. Cl.[7] ..... H01P 1/18
(52) U.S. Cl. ..... 333/161; 342/375
(58) Field of Search ..... 333/161, 159; 342/368, 372, 375

(56) References Cited

U.S. PATENT DOCUMENTS 3,440,573 A * 4/1969 Butler ..... 333/161
3,656,179 A * 4/1972 De Loach ..... 333/161
4,675,625 A * 6/1987 Johnston ..... 333/161
5,905,462 A * 5/1999 Hampel et al. ..... 333/159 X
5,949,303 A * 9/1999 Arvidsson et al. ..... 333/161 X

FOREIGN PATENT DOCUMENTS

DE 3113452 * 11/1982 ..... 333/161
JP 24203 * 2/1983 ..... 333/33
JP 6188606 * 7/1994 ..... 333/161

* cited by examiner

*Primary Examiner*—Benny Lee
(74) *Attorney, Agent, or Firm*—Sughrue Mion, PLLC

(57) ABSTRACT

This invention discloses an adjustable, relatively small phase-shiftable network for an antenna array, which can be incorporated into a PCB distribution network. The network comprises a PCB distribution element (A) comprising a planar dielectric circuit board (2) supporting a pattern of conductive tracks (3). The conductive tracks and the dielectric circuit board form a transmission line network which splits a signal applied to a signal input terminal (I) into three paths that terminate respectively in three terminals (T', B'and C') for feeding the input signal to Top (T'), Bottom (B') and Center (C') sections of a antenna array. The distribution element (A) is supported in a spaced relationship with a conductive ground plane (B). A moveable planar dielectric element (C) having a series of teeth (4, 5) along opposite edges, is slidably mounted over the top surface of the distribution element (A). The moveable dielectric element (C) is supported in a slidable manner by two rods (6, 7) attached to the ground plane (B). By moving the dielectric element, the phases in the top and bottom sections of the antenna array are changed in opposite directions so that the phase shift in one section is increased and the other section is decreased, which causes the radiating beam to tilt.

13 Claims, 9 Drawing Sheets

PHASE SHIFTER ARRANGEMENT HAVING RELATIVELY MOVABLE MEMBER WITH PROJECTIONS

BACKGROUND OF THE INVENTION

This invention relates to antennas and in particular to an arrangement to electrically down-tilt the electromagnetic wave pattern associated with a transmit antenna array, or electrically re-orient a receive antenna array.

It is sometimes desirable to adjust the orientation of the electromagnetic wave pattern of a transmit antenna array, particularly a downward adjustment, typically 0°to 15°below horizontal, when the antenna is located at a higher altitude than other antennas that communicate with the transmit antenna array. The downward adjustment of the radiation pattern alters the coverage area and may enhance communication with mobile users situated in shadowed areas below the transmit antenna array.

Besides actually mechanically tilting the entire antenna assembly, it is known to electrically down tilt the radiation pattern by controllably varying the relative phase or phases between two or more radiating elements of the antenna array.

One known method by which the relative phase between two or more radiating elements can be changed is to change the relative lengths of respective transmission lines connecting the antenna's common feed point to each element of the antenna array. Typically, various predetermined lengths of jumper cable are provided which are selectively connected between the common feed and each element to obtain a desired down-tilt. The jumper cables include co-axial connectors to facilitate connection. Furthermore, if stripline is used to connect the common feed point to the respective elements of the antenna array, some form of transition means is required to couple the jumper cable's co-axial connections to the strip line. A disadvantage of this known method is that it is relatively expensive, less reliable and susceptible to the generation of intermodulation products.

Another known method by which the relative phase between two or more radiating elements can be changed is to change the propagation velocity of the transmission line connecting the common feed point to at least some of the elements of the antenna array. Typically, this latter method is achieved by selectively changing the dielectric constant of the transmission line dielectric. If the transmission line is in the form of a conductive strip, the propagation velocity thereof is changed by introducing a dielectric material between the strip and its associated ground plane.

It is, however, well understood that the introduction of dielectric material under such a conductive strip causes the strip's normal impedance to be disturbed. For example, if a conductive strip having a certain width is spaced above a ground-plane at a certain distance such as to present a 50 ohm impedance, the introduction of dielectric material between the conductive strip and the ground-plane will reduce the value of this impedance to a value that depends upon the effective dielectric constant of the dielectric material. The resulting impedance mismatch would cause a degradation of return-loss performance of the antenna array.

Australian Patent No. 664625 discloses an arrangement of an adjustable phase shifter comprising dielectric phase shifter elements moveably interposed between conductive strips that couple radiating elements, and a common ground plane. The phase shifter elements are of a characteristic configuration which avoids disturbing the normal impedance during adjustment. This known arrangement, however, requires that respective phase shifter elements be located between each active strip line and the conductive ground plane. Such an arrangement imposes constructional disadvantages as well as limitations to the range of phase shift produced, which consequently imposes limits to the range of tilt.

SUMMARY OF THE INVENTION

It is an object of the present invention to provide an adjustable phase shifter arrangement of improved simplicity and compactness.

It is a further object of the present invention to provide an adjustable phase-shifter arrangement which allows a single phase-shifter element of relatively small dimensions to adjust the electrical beam tilt of a multi-element antenna array in a simple manner.

It is still a further object of the invention to provide a phase-shifter arrangement which allows a relatively wide range of phase shift.

According to a first aspect of the invention there is provided a phase shifter element comprising a substantially planar conductor means arranged to form at least one signal path, the at least one signal path including a signal input means at one end thereof, a signal output means at the other end thereof and an intermediate section of conductor, the conductor means being supported in a substantially parallel relationship with a conductive ground plane member, wherein the phase shifter element further includes a planar dielectric member adjacent the conductor means such that the conductor means is between the plane of the dielectric member and the ground plane, and a variable adjustment means arranged to selectively produce relative movement between the conductor means and the planar dielectric member in a direction which traverses the intermediate section of the conductor means, the phase of a signal at the signal output means being determined by the extent to which the planar dielectric member overlaps the conductor means, such overlap being varied by the relative movement.

According to a second aspect of the invention, there is provided a phase shifter element comprising a transmission line means formed by a planar first dielectric member having a first surface opposite a second surface, the first surface supporting thereon a pattern of at least one conductive track arranged to form a signal path of a predetermined physical length, the at least one signal path including a signal input means at one end thereof, a signal output means at the other end thereof and an intermediate section of conductive track, the transmission line means being supported in a substantially parallel relationship with a conductive ground plane member, the ground plane member being spaced from or contiguous with the dielectric member's second surface, wherein the phase shifter element further includes a second planar dielectric member adjacent the first surface of the first dielectric member, and variable adjustment means arranged to selectively produce relative movement between the first and second dielectric members in a direction which traverses the intermediate section of the at least one conductive track, the phase of a signal at the signal output means being determined by the extent to which the second dielectric member overlaps the pattern of the at least one conductive track, such overlap being varied by the relative movement.

According to a third aspect of the invention there is provided a phase shifter element comprising a transmission line means formed by a planar first dielectric member having a first surface opposite a second surface, the first surface supporting thereon a pattern of at least one conductive track arranged to form a signal path of a predetermined physical length, the path including a signal input means at one end thereof, a signal output means at the other end thereof and an intermediate section of conductive track, the transmission line means being supported in a substantially parallel relationship with a conductive ground plane member, the ground plane member being spaced from or contiguous with the dielectric member's second surface, wherein the phase shifter element further includes a second planar dielectric member adjacent the first surface of the first dielectric member, the second planar dielectric member including at least two opposite edges, and variable adjustment means arranged to selectively produce relative linear movement between the first and second dielectric members in a direction which is transverse the intermediate section of the at least one conductive track, the phase of a signal at each of the signal output means being determined by the extent to which the second dielectric member overlaps the pattern of the at least one conductive track, such overlap being varied by the relative linear movement.

Preferably, the variable adjustment means comprises an arrangement of the second planar dielectric member slidably fixed adjacent the first surface of the first planar dielectric member, the phase of a signal at the signal output means being determined by the extent to which the second planar dielectric member overlaps the pattern of the conductive track(s), such overlap extent being varied by linear movement of the second planar dielectric member.

BRIEF DESCRIPTION OF THE DRAWINGS

In order that the invention may be readily carried into effect, an embodiment thereof will now be described in relation to figures of the accompanying drawings, in which.

DETAILED DESCRIPTION OF THE INVENTION

Figure 1:
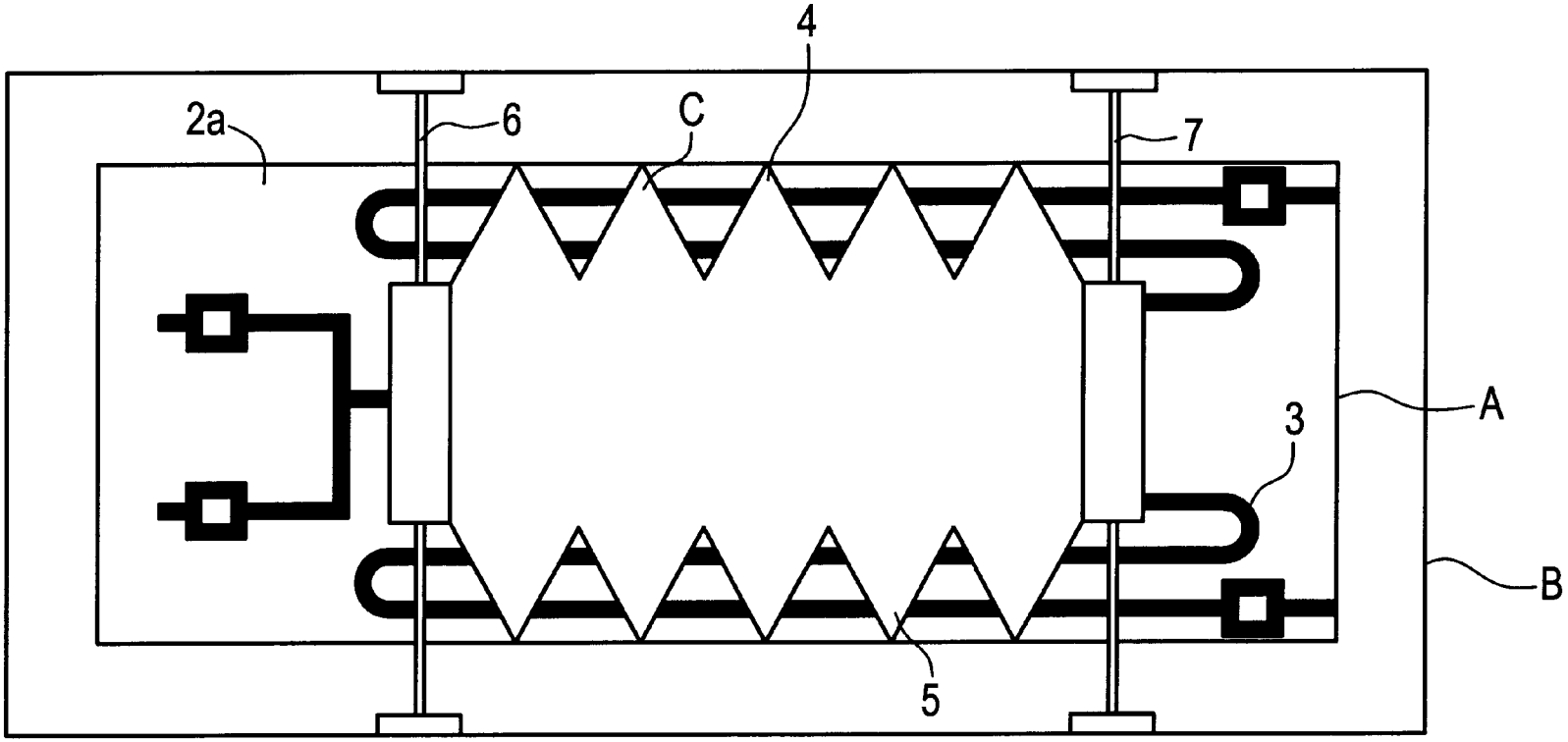
FIG. 1 is a top view of a first embodiment of the phase-shifter arrangement of the present invention.
Figure 2:
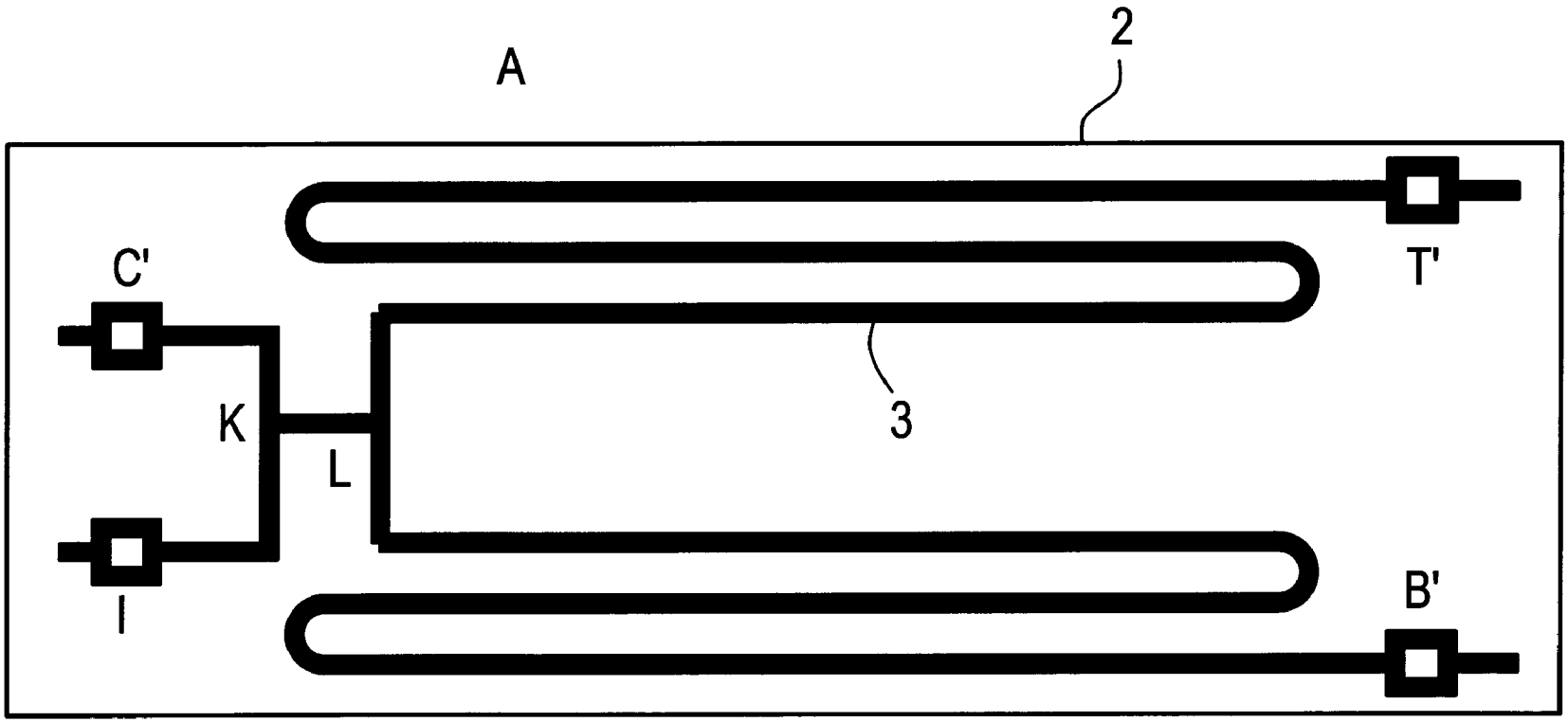
FIG. 2 is a top view of a printed circuit board (PCB), distribution element incorporated in the phase-shifter arrangement shown in FIG. 1.
Figure 3:
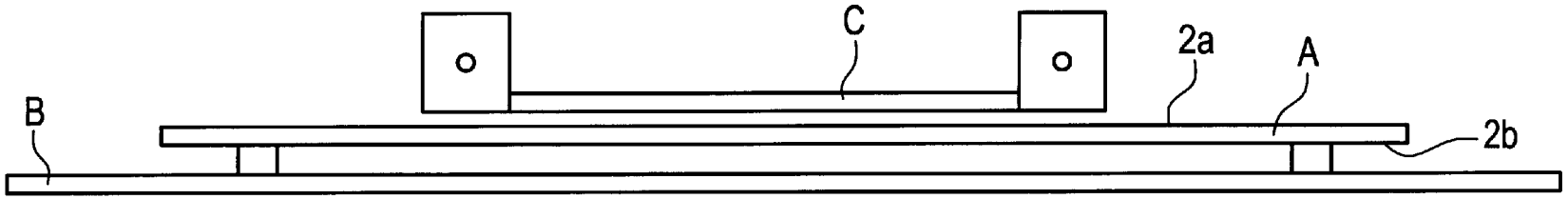
FIG. 3 is a side view of the phase-shifter arrangement shown in FIG. 1.
Figure 4:
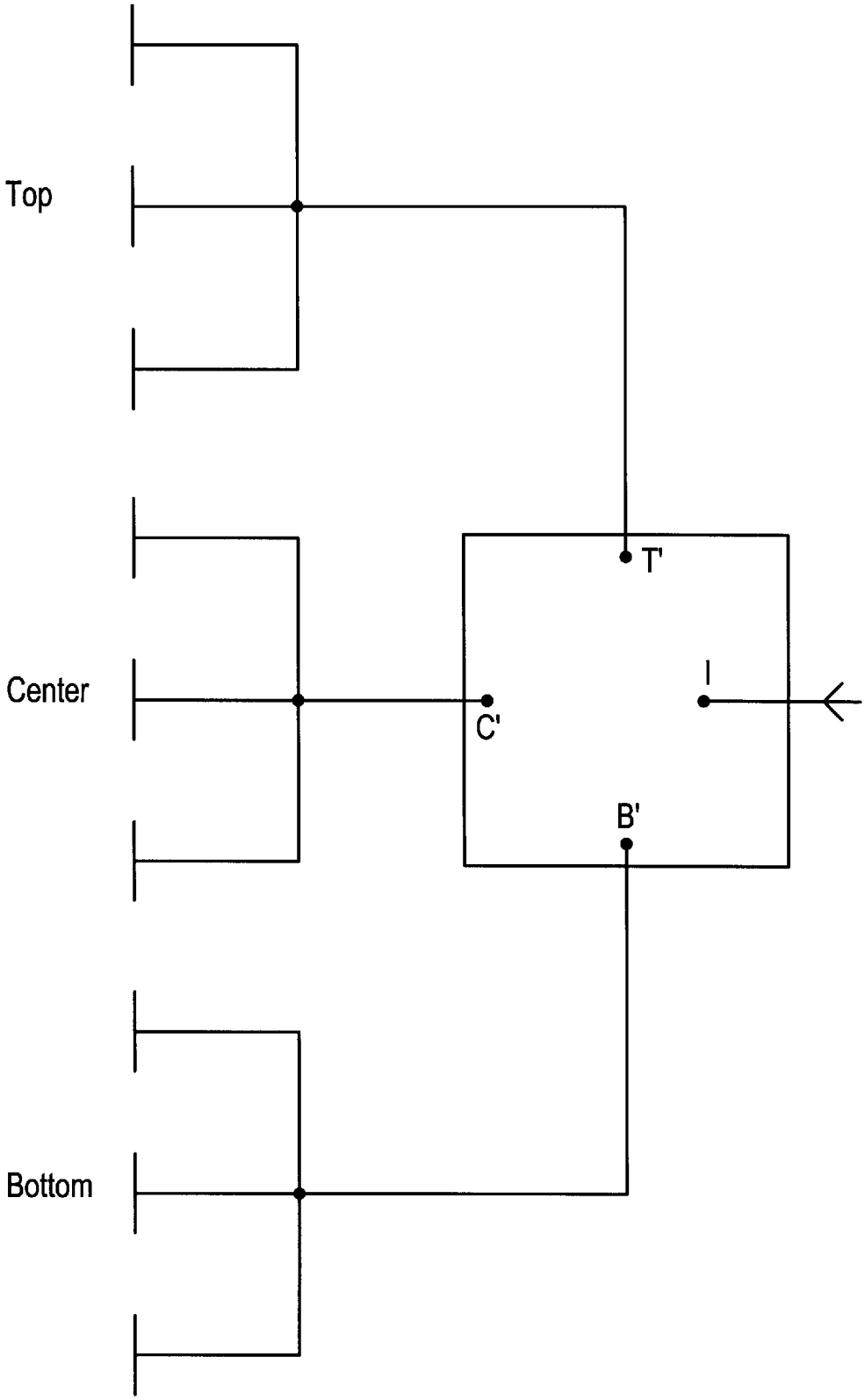
FIG. 4 is a schematic layout of an antenna array incorporating the phase-shifter shown in FIG. 1.
Figure 5:
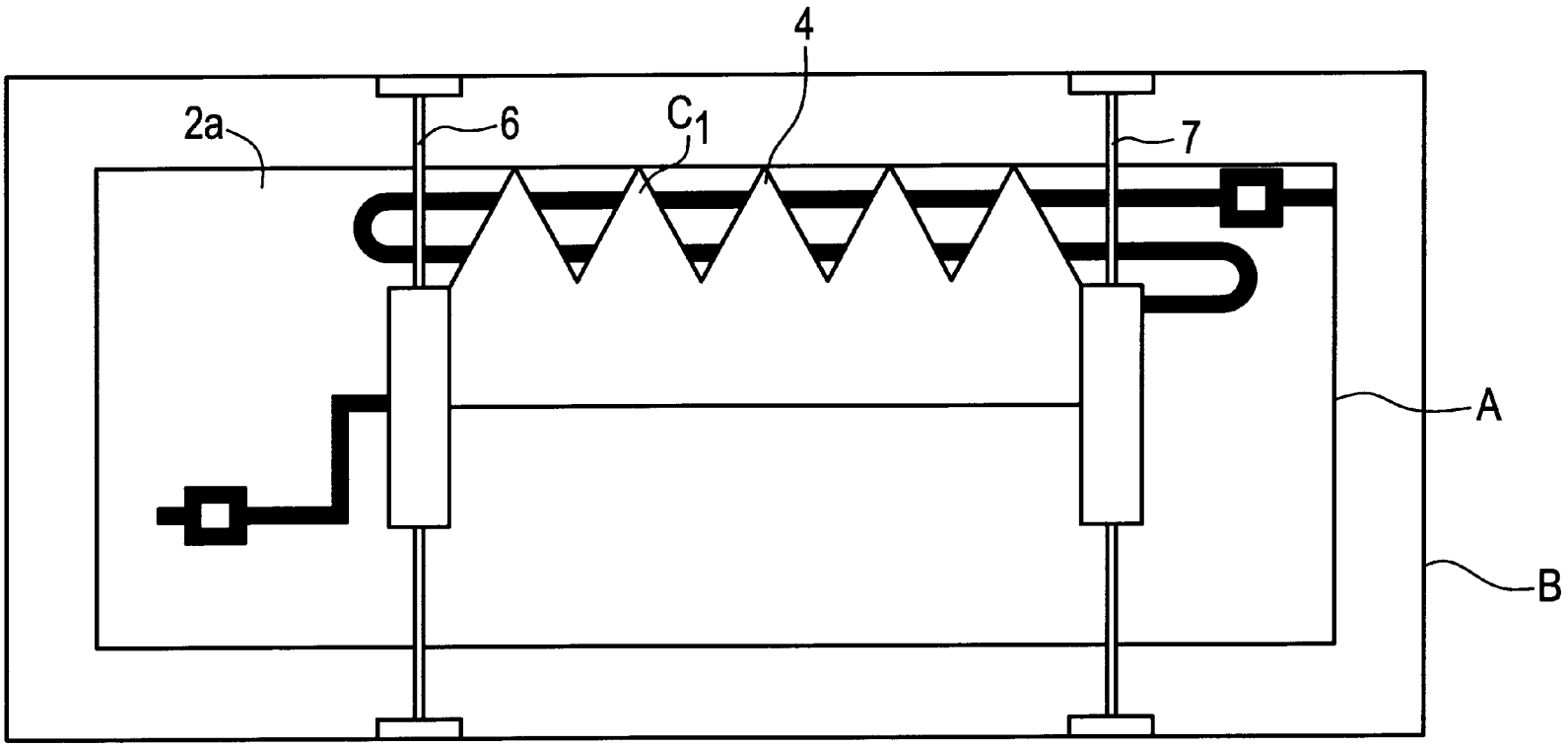
FIG. 5 shows a top view of a second embodiment of the phase-shifter arrangement of the present invention.

Referring to FIGS. 1–4 of the drawings, there is shown a PCB distribution element A, FIGS. 2 and 5, comprising a planar dielectric circuit board 2 (FIG. 2) supporting a pattern of conductive tracks 3 (FIGS. 1, 2) on a first surface 2*a* thereof (FIGS. 1, 3 and 5). The conductive tracks and the dielectric circuit board form a transmission line network for splitting a signal applied to a signal input terminal I (FIGS. 2, 4 and 7) into three paths that terminate respectively in three terminals T, B and C (FIGS. 2, 4) for feeding the input signal to the Top T (FIG. 7), Bottom B (FIG. 7) and Center C sections of an antenna array (see FIGS. 2 and 4). Certain paths of the conductive tracks join terminals I and C, specifically shown in FIG. 2 as K, where serpentine conductive tracks split apart at point L, one track going to terminal T and the other to terminal B. The distribution element A is supported in a spaced relationship with a conductive ground plane B, the planar dielectric board's second surface 2*b* (FIG. 3) and the ground plane facing one another, as shown in FIG. 3.

Figure 9:
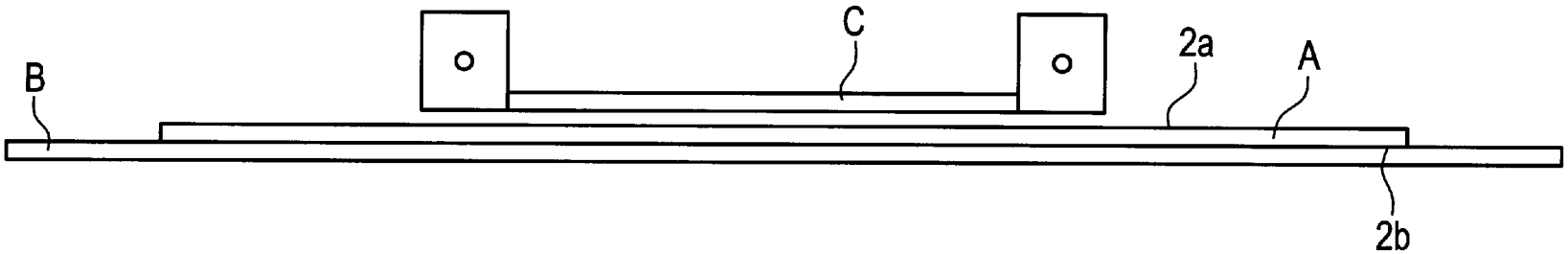
FIG. 9 is a side view of the phase shifter arrangement, similar to that shown in FIG. 3 but having the ground plane contiguous with the lower surface of the printed circuit board.

Alternately, the second surface 2*b* (FIG. 3) of the the circuit board and the ground plane can be contiguous (as shown in FIG. 9).

A moveable planar dielectric element C, shown in FIG. 1, having a series of teeth 4, 5 (FIG. 1) along opposite edges, is slidably mounted and adjacent to the top surface of the distribution element A. The moveable dielectric element C is supported in a linear slidable manner by two parallel rods 6, 7 (FIGS. 1 and 5) attached to the ground plane B. It will be understood that a rotational arrangement of a dielectric element could be adapted, and is envisaged.

By selectively moving the dielectric element, the phases in the top and bottom 20 sections of the antenna array are changed in opposite directions so that the phase in one section is increased and in the other section is decreased, which causes the radiating beam to tilt.

Figure 6:
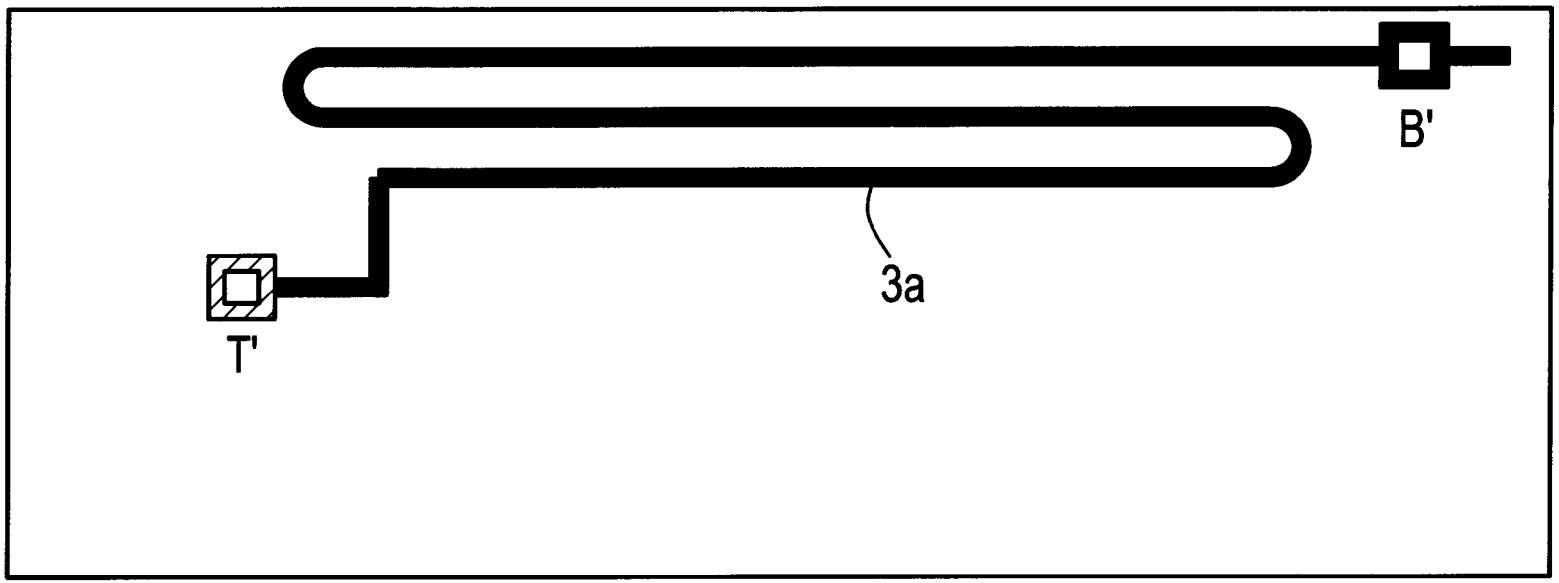
FIG. 6 shows a top view of a PCB element incorporated in the phase-shifter arrangement shown in FIG. 5.
Figure 7:
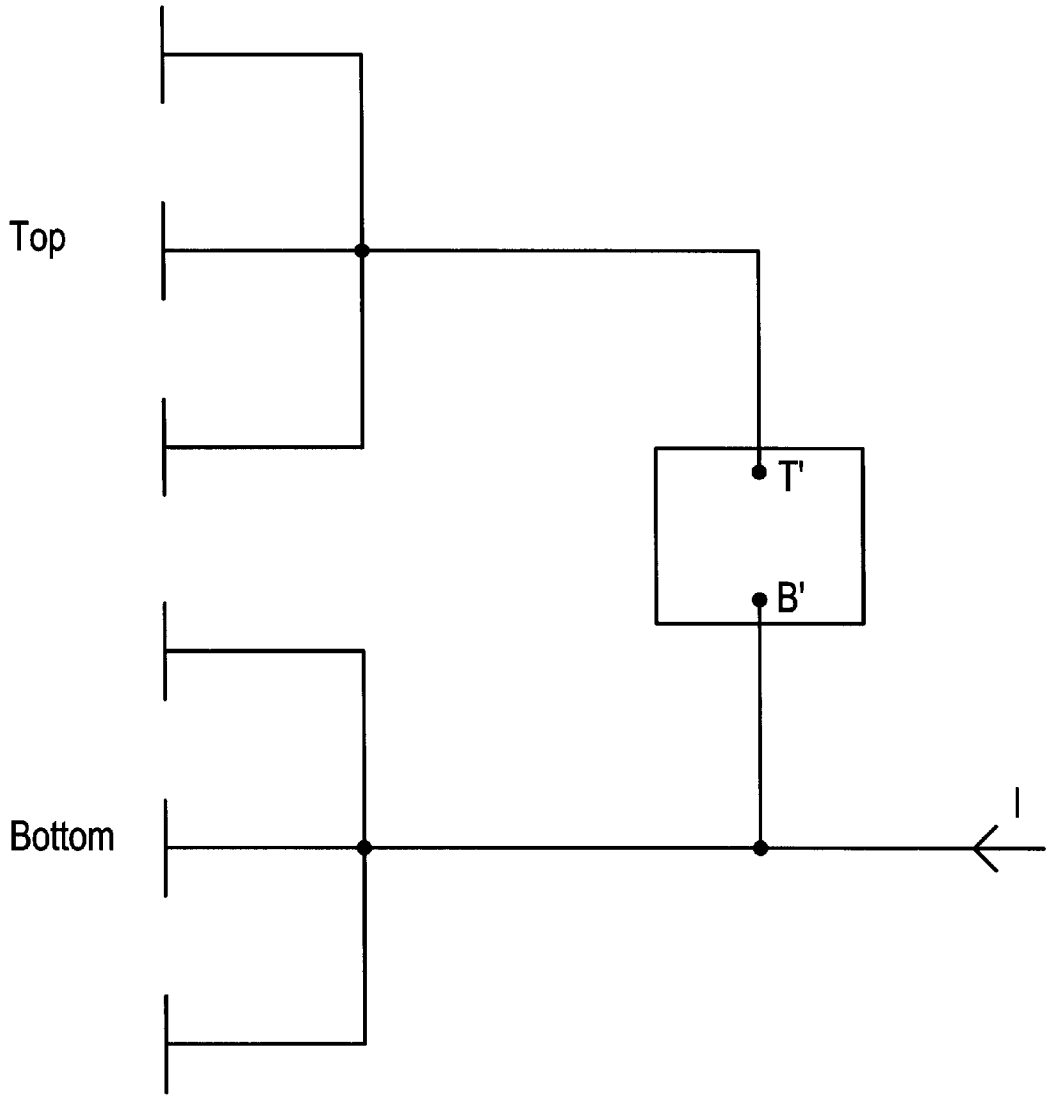
FIG. 7 is a schematic layout of an antenna array incorporating the phase-shifter arrangement shown in FIG. 5.

Referring to FIGS. 5–7 of the drawings, elements having the same labels as described with respect to FIGS. 1–4 are the same as described above and have the same function. FIGS. 5–7 show a second embodiment of the invention for use with a two section antenna array (FIG. 7). The phase-shifter arrangement of this embodiment is similar to the one described in relation to FIGS. 1–4, except that only a single elongated, serpentine conductive track 3*a* is provided to form a transmission line whose distal ends terminate at respective terminals T and B, as shown in FIG. 6. A moveable dielectric element Cl is in the form of a bisected dielectric element shown in FIG. 5. It will be understood that a rotational arrangement of the dielectric 30 element could be adapted for the arrangement shown in FIG. 5.

Figure 8:
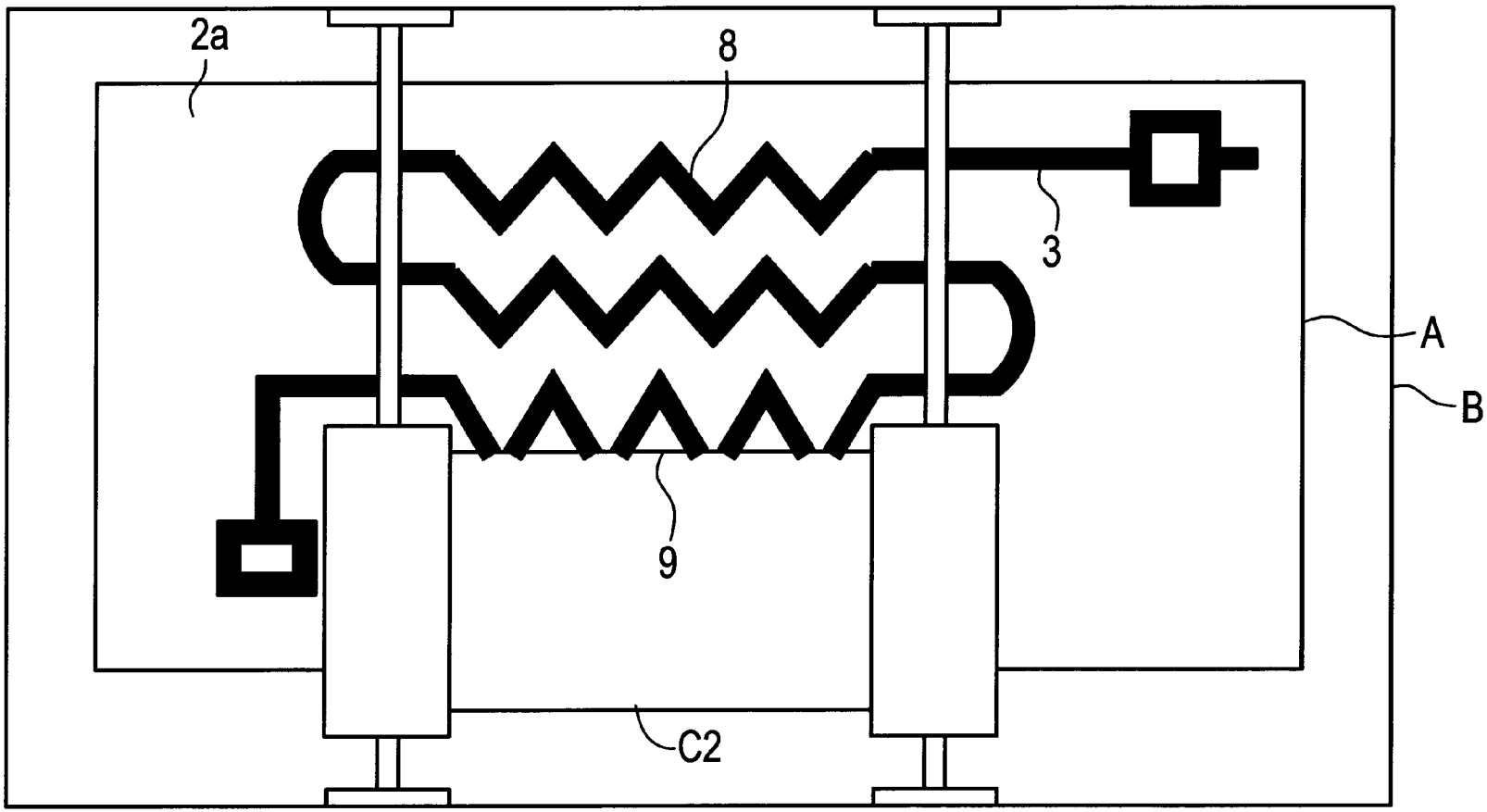
FIG. 8 is a top view of a third embodiment of the phase-shifter arrangement of the present invention.

Referring to FIG. 8, elements having the same labels as described with respect to FIGS. 1–7 are the same as described above and have the same function. FIG. 8 shows an embodiment which, instead of using a series of teeth along edges of the movable planar dielectric element (Cl), as shown, for example, in FIG. 5, an electrically equivalent configuration is used. This is achieved by providing the conductive tracks 3 with a non-linear portion in the form of a meandering pattern 8 of a triangular configuration. Other configurations, such as, for example, trapezoid or semi-ellipsoid could be adapted. In the embodiment shown in FIG. 8, the movable dielectric element C2 is provided with a straight edge 9.

The claims defining the invention are as follows:

1. A phase shifter element comprising a substantially planar conductor arranged to provide at least one signal path, the at least one signal path including a signal input at one end thereof, a signal output at the other end thereof and an intermediate section of conductor, said planar conductor being supported in a substantially parallel relationship with a conductive ground plane member, wherein said phase shifter element further includes a planar dielectric member adjacent said planar conductor such that the planar conductor is between the planar dielectric member and the ground plane, and a variable adjustment means arranged to selectively produce relative movement between the planar conductor and the planar dielectric member in a direction which traverses said intermediate section of conductor, the phase of a signal at the signal output being determined by the extent to which the planar dielectric member overlaps said planar conductor, such overlap being varied by said relative movement, wherein at least one of said intermediate section of said conductor and planar dielectric member having an edge with a plurality of projections extending in a direction parallel to the direction of said relative movement, such that an amount of overlap between the planar conductor and the planar dielectric member is segmented to produce a stable impedance, said intermediate section of said conductor includes at least one portion extending substantially in a first direction, said relative movement between the planar dielectric member and said planar conductor is in a direction substantially transverse to said first direction, and at least one of said portion of said intermediate conductor and said planar dielectric member has said edge with said plurality of projections.

2. An antenna array including a phase shifter element claimed in claim 1.

3. A phase shifter element comprising a transmission line provided by a planar first dielectric member having a first surface opposite a second surface, said first surface supporting thereon a pattern of at least one conductive track arranged to provide a signal path of a predetermined physical length, the at least one conductive track including a signal input at one end thereof, a signal output at the other end thereof and an intermediate section of conductive track, said transmission line being supported in a substantially parallel relationship with a conductive ground plane member, said ground plane member being either spaced from or contiguous with said dielectric member's second surface, wherein said phase shifter element further includes a second planar dielectric member adjacent said first surface of said first dielectric member, said second planar dielectric member including at least two opposite edges, and variable adjustment means arranged to selectively produce relative linear movement between the first and second dielectric members in a direction which is transverse to said intermediate section of conductive track, the phase of a signal at the respective signal output being determined by the extent to which said second dielectric member overlaps said pattern of said at least one conductive track, such overlap being varied by said relative linear movement, wherein at least one of said at least one conductive track and said second dielectric member having an edge with a plurality of projections extending in a direction parallel to the direction of said relative movement, such that an amount of overlap between the at least one conductive track and the second dielectric member is segmented to produce a stable impedance, said intermediate section of conductive track includes at least one portion extending substantially in a first direction, said relative movement between said first and second dielectric members is in a direction substantially transverse to said first direction, and at least one of said at least one portion of said intermediate section of conductive track and said second dielectric member has said edge with said plurality of projections.

4. A phase shifter element as claimed in claim 3, wherein said variable adjustment means comprises an arrangement of said second planar dielectric member slidably fixed adjacent said first surface of said first planar dielectric member, the phase of a signal at the respective signal output being determined by the extent to which said second planar dielectric member overlaps said pattern of said at least one conductive track, such overlap extent being varied by linear movement of said second planar dielectric member.

5. A phase shifter element as claimed in claim 4, wherein the intermediate section of the at least one conductive track includes a corresponding non-linear portion in the form of a meandering pattern.

6. A phase shifter element as claimed in claim 5, wherein said meandering pattern is a sawtooth configuration.

7. A phase shifter element as claimed in claim 5, wherein at least one of said two opposite edges of the second planar dielectric member is a substantially straight edge.

8. A phase shifter element comprising a transmission line provided by a planar first dielectric member having a first surface opposite a second surface, said first surface supporting thereon a pattern of at least one conductive track arranged to provide a signal path of a predetermined physical length, the at least one conductive track including a signal input at one end thereof, a signal output at the other end thereof and an intermediate section of conductive track, said transmission line being supported in a substantially parallel relationship with a conductive ground plane member, said ground plane member being either spaced from or contiguous with said dielectric member's second surface, wherein said phase shifter element further includes a second planar dielectric member adjacent said first surface of said first dielectric member, said second planar dielectric member including at least two opposite edges, and variable adjustment means arranged to selectively produce relative linear movement between the first and second dielectric members in a direction which is transverse to said intermediate section of conductive track, the phase of a signal at the respective signal output being determined by the extent to which said second dielectric member overlaps said pattern of said at least one conductive track, such overlap being varied by said relative linear movement;

wherein at least one of said at least one conductive track and said second dielectric member having an edge with a plurality of projections extending in a direction parallel to the direction of said relative movement, such that an amount of overlap between the at least one conductive track and the second dielectric member is segmented to produce a stable impedance, wherein said variable adjustment means comprises an arrangement of said second planar dielectric member slidably fixed adjacent said first surface of said first planar dielectric member, the phase of a signal at the respective signal output being determined by the extent to which said second planar dielectric member overlaps said pattern of said at least one conductive track, such overlap extent being varied by linear movement of said second planar dielectric member, and wherein said second planar dielectric member includes a plurality of extension members extending from at least one said edge thereof.

9. A phase shifter element as claimed in claim 8, wherein said plurality of extension members comprise at least two triangular-shaped extensions.

10. A phase shifter element comprising a transmission line provided by a planar first dielectric member having a first surface opposite a second surface, said first surface supporting thereon a pattern of at least one conductive track arranged to provide a signal path of a predetermined physical length, the at least one conductive track including a signal input at one end thereof, a signal output at the other end thereof and an intermediate section of conductive track, said transmission line being supported in a substantially parallel relationship with a conductive ground plane member, said ground plane member being either spaced from or contiguous with said dielectric member's second surface, wherein said phase shifter element further includes a second planar dielectric member adjacent said first surface of said first dielectric member, and variable adjustment means arranged to selectively produce relative movement between the first and second dielectric members in a direction which traverses said intermediate section of conductive track, the phase of a signal at the signal output being determined by the extent to which said second dielectric member overlaps said pattern of said at least one conductive track, such overlap being varied by said relative movement, wherein at least one of said at least one conductive track and said second dielectric member having an edge with a plurality of projections extending in a direction parallel to the direction of said relative movement, such that an amount of overlap between the at least one conductive track and the second dielectric member is segmented to produce a stable impedance, said intermediate section of conductive track includes at least one portion extending substantially in a first direction, said relative movement between said first and second dielectric members is in a direction substantially transverse to said first direction, and at least one of said at least one portion of said intermediate section of conductive track and said second dielectric member has said edge with said plurality of projections.

11. A phase shifter element as claimed in claim 10, wherein said at least one portion of said intermediate section is a part of a folded serpentine configuration.

12. A phase shifter element as claimed in claim 10, wherein said pattern of the least one conductive track is arranged to provide three paths comprising two outer paths and a central path, said signal input comprising a common signal input at one end thereof and said output at the other end thereof.

13. A phase shifter element comprising a transmission line provided by a planar first dielectric member having a first surface opposite a second surface, said first surface supporting thereon a pattern of at least one conductive track arranged to provide a signal path of a predetermined physical length, the at least one conductive track including a signal input at one end thereof, a signal output at the other end thereof and an intermediate section of conductive track, said transmission line being supported in a substantially parallel relationship with a conductive ground plane member, said ground plane member being either spaced from or contiguous with said dielectric member's second surface, wherein said phase shifter element further includes a second planar dielectric member adjacent said first surface of said first dielectric member, said second planar dielectric member including at least two opposite edges, and variable adjustment means arranged to selectively produce relative linear movement between the first and second dielectric members in a direction which is transverse to said intermediate section of conductive track, the phase of a signal at the respective signal output being determined by the extent to which said second dielectric member overlaps said pattern of said at least one conductive track, such overlap being varied by said relative linear movement;

wherein at least one of said at least one conductive track and said second dielectric member having an edge with a plurality of projections extending in a direction parallel to the direction of said relative movement, such that an amount of overlap between the at least one conductive track and the second dielectric member is segmented to produce a stable impedance, wherein said variable adjustment means comprises an arrangement of said second planar dielectric member slidably fixed adjacent said first surface of said first planar dielectric member, the phase of a signal at the respective signal output being determined by the extent to which said second planar dielectric member overlaps said pattern of said at least one conductive track, such overlap extent being varied by linear movement of said second planar dielectric member, and wherein said second planar dielectric member includes a plurality of extension members extending from each of said two opposite edges of the second planar dielectric member.

* * * * *